US006360892B1

(12) United States Patent
Chen

(10) Patent No.: US 6,360,892 B1
(45) Date of Patent: Mar. 26, 2002

(54) WRENCH SUPPORT RACK ASSEMBLY

(76) Inventor: Ander Chen, No. 20, Kuan Chien Street, Lu Kang Chen, Chang Hua Hsien (TW)

( * ) Notice: Subject to any disclaimer, the term of this patent is extended or adjusted under 35 U.S.C. 154(b) by 0 days.

(21) Appl. No.: 09/609,747

(22) Filed: Jul. 3, 2000

(51) Int. Cl.[7] ..... B65D 85/20
(52) U.S. Cl. ..... 206/376; 211/70.6
(58) Field of Search ..... 206/376, 377; 81/125.1; 211/70.6; D8/71; 294/161

(56) References Cited

U.S. PATENT DOCUMENTS 1,808,190 A * 6/1931 Vlchek ..... 206/376
1,809,450 A * 6/1931 Platt ..... 206/376
1,810,108 A * 6/1931 Kress ..... 206/376
1,830,577 A * 11/1931 Vallone ..... 206/376
1,875,815 A * 9/1932 Kneier ..... 206/376
1,877,466 A * 9/1932 Koster ..... 206/376
1,889,203 A * 11/1932 Kress ..... 206/376
1,922,102 A * 8/1933 Kroecker ..... 206/376
1,995,687 A * 3/1935 Schaumburg ..... 206/376
2,030,147 A * 2/1936 Moore ..... 206/376
2,030,148 A * 2/1936 Coyle ..... 206/376
2,181,764 A * 11/1939 Murray ..... 206/376
3,370,696 A * 2/1968 Groe ..... 206/376

* cited by examiner

*Primary Examiner*—Bryon P. Gehman
(74) *Attorney, Agent, or Firm*—Charles E. Baxley

(57) ABSTRACT

A wrench support rack assembly includes a support rack having a base plate having a first side and a second side, a side plate mounted on the first side of the base plate, a top plate mounted on the side plate and arranged in parallel with the base plate, and a plurality of spaced support plates each mounted on the side plate, thereby defining a plurality of receiving chambers between the top plate and the base plate each having a closed wall and an open wall. A retaining piece is mounted on the support plates of the support rack for sealing the open wall of each of the receiving chambers and has a first end pivotally mounted on the second side of the base plate and a second end detachably secured on the top plate.

5 Claims, 3 Drawing Sheets

WRENCH SUPPORT RACK ASSEMBLY

BACKGROUND OF THE INVENTION

1. Field of the Invention

The present invention relates to a support rack assembly, and more particularly to a wrench support rack assembly.

2. Description of the Related Art

A conventional wrench suspension rack in accordance with the prior art is used for hanging wrenches on the wall so that the wrenches can be displayed in the place such as a supermarket, a retail store or the like, thereby facilitating the consumer choosing and buying the wrenches according to their different requirements.

However, the user has to cut the wrench suspension rack so as to remove the wrenches from the wrench suspension rack for use. In such a manner, the wrench suspension rack is broken so that the wrench suspension rack has to be thrown away and cannot be used for storing the wrenches when the wrenches are not is use, thereby decreasing the versatility of the wrench suspension rack. Accordingly, it is necessary for the user to additionally provide a wrench holder for holding the wrenches, so increasing the cost of using the wrenches.

SUMMARY OF THE INVENTION

The present invention has arisen to mitigate and/or obviate the disadvantage of the conventional wrench suspension rack and wrench holder.

In accordance with the present invention, there is provided a wrench support rack assembly comprising: a support rack including a base plate having a first side and a second side, a side plate mounted on the first side of the base plate, a top plate mounted on the side plate and arranged in parallel with the base plate, and a plurality of spaced support plates each mounted on the side plate, thereby defining a plurality of receiving chambers between the top plate and the base plate, each of the receiving chambers including a closed wall and an open wall; and a retaining piece mounted on the support plates of the support rack for sealing the open wall of each of the receiving chambers and including a first end pivotally mounted on the second side of the base plate and a second end detachably secured on the top plate. Each of the support plates is provided with a flexible press plate extending into the receiving chamber in an inclined manner.

The second side of the base plate defines a receiving space having two ends each provided with a lug provided with a pivot axle, and the first end of the retaining piece is provided with a pivot shaft pivotally mounted in the receiving space and having two ends each defining a pivot hole for receiving the respective pivot axle therein so that the pivot shaft is pivotally mounted on the pivot axle of the lug of each of the two ends of the receiving space of the base plate.

The top plate defines a receiving recess, and the second end of the retaining piece is provided with an extension received in the receiving recess of the top plate and provided with a hook detachably urged on an edge of the top plate.

In assembly, tools such as wrenches or the like can be rigidly and stably supported on the support plates of the support rack without a possibility of detaching from the receiving chambers of the support rack due to the exact positioning effect of the retaining piece. The extension of the retaining piece can also be easily and rapidly detached from the support rack by detaching the hook from the edge of the top plate so that the wrenches can be easily and rapidly removed from the receiving chambers of the support rack, thereby greatly facilitating the user using the wrenches.

In addition, each of the press plates can be used for temporarily positioning the wrenches in the receiving chambers when the retaining piece is opened.

In practice, tools such as wrenches or the like can be rigidly held and positioned on the support plates of the support rack of the wrench support rack assembly so that the wrenches can be displayed in the place such as a supermarket, a retail store or the like, thereby facilitating a consumer choosing and buying the wrenches according to their different requirements.

Accordingly, the wrench support rack assembly in accordance with the present invention can be adapted to function as a wrench suspension rack and a wrench holder.

Further benefits and advantages of the present invention will become apparent after a careful reading of the detailed description with appropriate reference to the accompanying drawings.

DETAILED DESCRIPTION OF THE INVENTION

Figure 1:
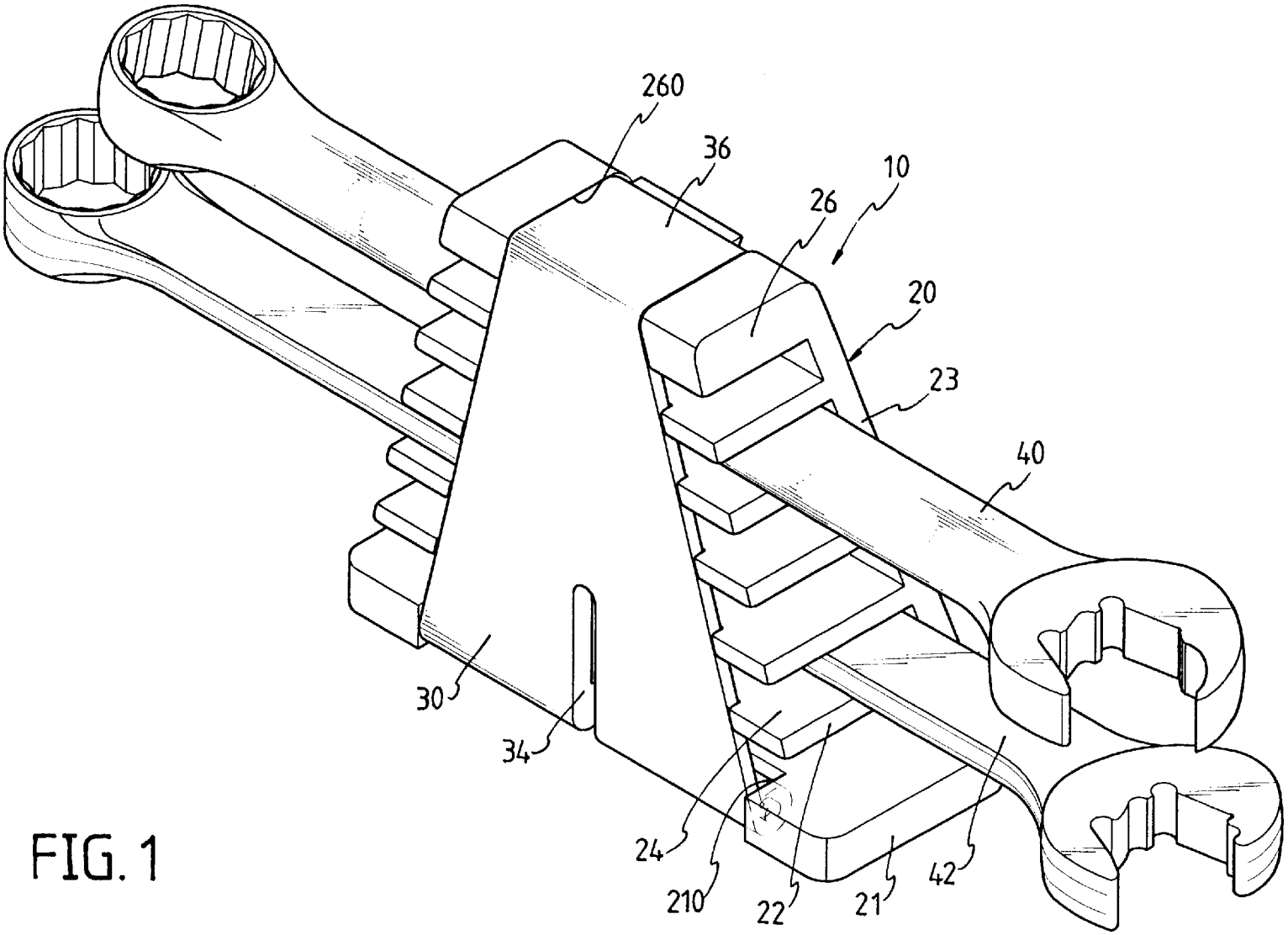
FIG. 1 is a perspective view of a wrench support rack assembly in accordance with the present invention.
Figure 2:
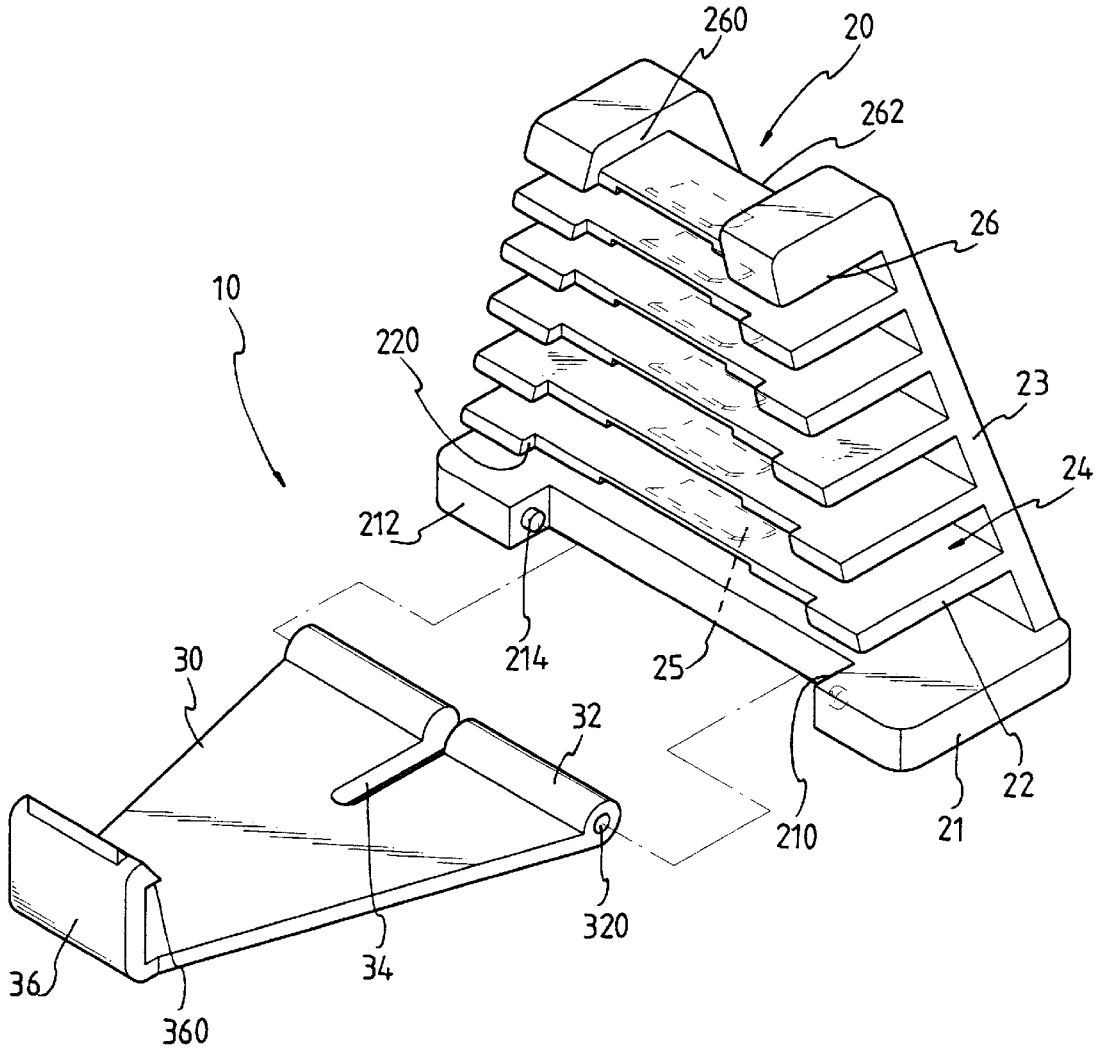
FIG. 2 is an exploded view of the wrench support rack assembly as shown in FIG. 1.
Figure 3:
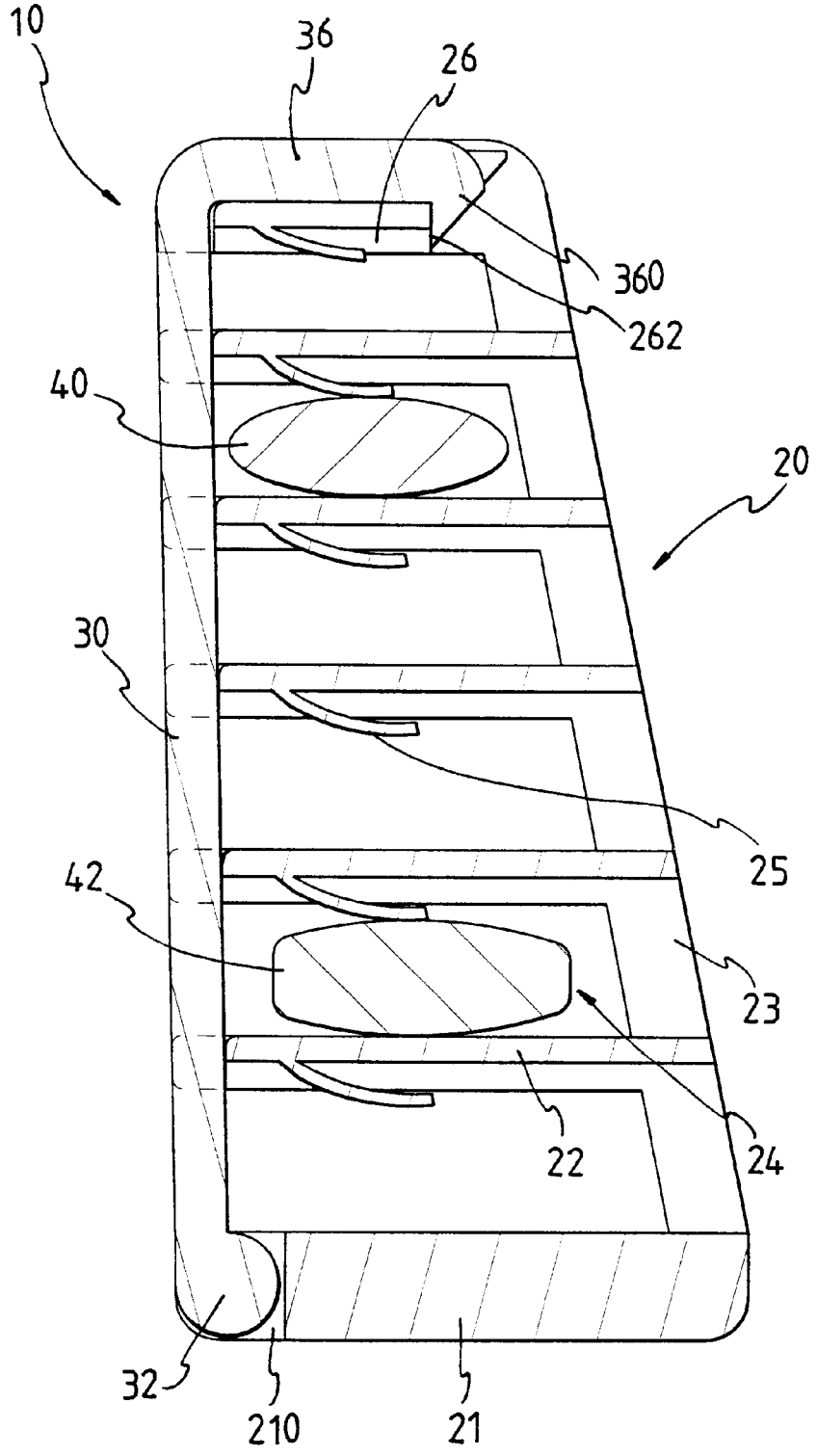
FIG. 3 is a side plan cross-sectional view of the wrench support rack assembly as shown in FIG. 1.

Referring now to FIGS. 1–3, a wrench support rack assembly 10 in accordance with the present invention comprises a support rack 20, and a retaining piece 30 detachably locked on the support rack 20.

The support rack 20 includes a base plate 21 having a first side and a second side, a side plate 23 mounted on the first side of the base plate 21, a top plate 26 mounted on the side plate 23 and arranged in parallel with the base plate 21, and a plurality of spaced support plates 22 each mounted on the side plate 23, thereby in turn defining a plurality of receiving chambers 24 between the top plate 26 and the base plate 21 for receiving wrenches 40 and 42 of different thickness. Each of the receiving chambers 24 includes a closed wall and an open wall as shown in FIG. 2. Each of the support plates 22 defines a receiving depression 220 for receiving the retaining piece 30. Each of the support plates 22 is provided with a flexible press plate 25 extending into the receiving chamber 24 in an inclined manner for positioning the wrenches 40 and 42. As shown in FIG. 3, the side plate 23 is inclined relative to the support plates 22.

The retaining piece 30 is mounted on the support plates 22 of the support rack 20 for sealing the open wall of each of the receiving chambers 24 and includes a first end pivotally mounted on the second side of the base plate 21 and a second end detachably secured on the top plate 26.

The second side of the base plate 21 defines a receiving space 210 having two ends each provided with a lug 212 provided with a pivot axle 214. The first end of the retaining piece 30 is provided with a cylindrical pivot shaft 32 pivotally mounted in the receiving space 210 and having two ends each defining a pivot hole 320 for receiving the respective pivot axle 214 therein so that the pivot shaft 32 is pivotally mounted on the pivot axle 214 of the lug 212 of each of the two ends of the receiving space 210 of the base plate 21. Preferably, the first end of the retaining piece 30 defines an elongated slot 34 extending through a mediate portion of the pivot shaft 32 for enhancing the flexibility of the pivot shaft 32 and the retaining piece 30.

The top plate 26 defines a receiving recess 260, and the second end of the retaining piece 30 is provided with an extension 36 received in the receiving recess 260 of the top plate 26 and provided with a hook 360 detachably urged on an edge 262 of the top plate 26.

In assembly, the two distal ends of the pivot shaft 32 of the retaining piece 30 are pressed toward each other so as to shorten the dimension of the elongated slot 34 so that the pivot shaft 32 of the retaining piece 30 can be inserted into the receiving space 210 of the base plate 21 and so that the pivot axle 214 of each of the two ends of the base plate 21 can be snapped into the pivot hole 320 of the pivot shaft 32 of the retaining piece 30. In such a manner, the pivot shaft 32 of the retaining piece 30 is pivotally mounted on the base plate 21.

The wrenches 40 and 42 of different thickness are then received into the receiving chambers 24 and are pressed by the press plates 25 as shown in FIG. 3 so as to be positioned in the receiving chambers 24.

The retaining piece 30 is then pivoted relative to the base plate 21 to be received into the receiving depression 220 of each of the support plates 22 for closing the open wall of each of the receiving chambers 24. The extension 36 is then received into the receiving recess 260 of the top plate 26 so that the hook 360 is snapped to be locked on the edge 262 of the top plate 26, thereby securing the retaining piece 30 on the support rack 20 as shown in FIG. 1 so that the wrenches 40 and 42 can be rigidly and stably supported on the support plates 22 of the support rack 20 without a possibility of detaching from the receiving chambers 24 of the support rack 20 due to the positioning effect of the retaining piece 30 as shown in FIG. 1.

The extension 36 of the retaining piece 30 can be easily and rapidly detached from the support rack 20 by detaching the hook 360 from the edge 262 of the top plate 26 so that the wrenches 40 and 42 can be easily and rapidly removed from the receiving chambers 24 of the support rack 20, thereby greatly facilitating the user using the wrenches.

In addition, each of the press plates 25 can be used for temporarily positioning the wrenches 40 and 42 in the receiving chambers 24 when the retaining piece 30 is opened.

It should be clear to those skilled in the art that further embodiments may be made without departing from the scope of the present invention.

What is claimed is:

1. A wrench support rack assembly comprising:

a support rack (20) including a base plate (21) having a first side and a second side, a side plate (23) mounted on the first side of said base plate (21), a top plate (26) mounted on said side plate (23) and arranged in parallel with said base plate (21), and a plurality of spaced support plates (22) each mounted on said side plate (23), thereby defining a plurality of receiving chambers (24) between said top plate (26) and said base plate (21), each of said receiving chambers (24) including a closed wall and an open wall; and a retaining piece (30) mounted on said support plates (22) of said support rack (20) for sealing said open wall of each of said receiving chambers (24) and including a first end pivotally mounted on said second side of said base plate (21) and a second end detachably secured on said top plate (26);

wherein, each of said support plates (22) defines a receiving depression (220) for receiving said retaining piece (30).

2. The wrench support rack assembly in accordance with claim 1, wherein said second side of said base plate (21) defines a receiving space (210) having two ends each provided with a lug (212) provided with a pivot axle (214), and said first end of said retaining piece (30) is provided with a pivot shaft (32) pivotally mounted in said receiving space (210) and having two ends each defining a pivot hole (320) for receiving said respective pivot axle (214) therein so that said pivot shaft (32) is pivotally mounted on said pivot axle (214) of said lug (212) of each of said two ends of said receiving space (210) of said base plate (21).

3. The wrench support rack assembly in accordance with claim 2, wherein said first end of said retaining piece (30) defines an elongated slot (34) extending through a mediate portion of said pivot shaft (32).

4. The wrench support rack assembly in accordance with claim 1, wherein said top plate (26) defines a receiving recess (260), and said second end of said retaining piece (30) is provided with an extension (36) received in said receiving recess (260) of said top plate (26) and provided with a hook (360) detachably urged on an edge (262) of said top plate (26).

5. The wrench support rack assembly in accordance with claim 1, wherein said side plate (23) is inclined relative to said support plates (22).

* * * * *